United States Patent [19]

Luttig

[11] 4,205,612

[45] Jun. 3, 1980

[54] RAIL ROLLER

[76] Inventor: Dale Luttig, Rte. 1, Emmett, Kans. 66422

[21] Appl. No.: 887,096

[22] Filed: Mar. 16, 1978

[51] Int. Cl.[2] ..... E01B 29/02; B61B 12/00

[52] U.S. Cl. ..... 104/1 R; 104/3

[58] Field of Search ..... 104/1 R, 2, 3, 135; 238/105; 193/35 R; 214/84; 308/20, 189 R

[56] References Cited

U.S. PATENT DOCUMENTS

| | | | |
|---|---|---|---|
| 914,937 | 3/1909 | Fiala | 104/2 |
| 1,163,627 | 12/1915 | Cochrane | 238/105 |
| 2,431,856 | 12/1947 | Ziegler | 308/20 |
| 3,053,368 | 9/1962 | Klahn | 193/35 R |
| 3,770,109 | 11/1973 | Kraft | 308/20 |
| 3,890,016 | 6/1975 | Stall | 308/20 |

FOREIGN PATENT DOCUMENTS

| | | | |
|---|---|---|---|
| 2307914 | 11/1976 | France | 104/3 |

*Primary Examiner*—Stephen G. Kunin
*Assistant Examiner*—Lawrence E. Williams
*Attorney, Agent, or Firm*—Leitner, Palan, Lyman, Martin & Bernstein

[57] ABSTRACT

A rail roller device constructed to include a cylindrically shaped roll surface, the ends of which are provided with radially extending end plates or flanges from which extend the roller shaft. Opposite ends of the roller shaft extend through steel ball bearings mounted within mounting brackets which are fixedly attached to the device frame. At least one retaining ring is located about the shaft between a ball bearing and an end plate. The generally rectangular shaped frame of the rail roller device is formed of four frame members each constructed from a length of angle iron. The frame is constructed so that a pair of frame members located parallel to the longitudinal axis of the roll surface can be set between rail ties.

9 Claims, 3 Drawing Figures

RAIL ROLLER

BACKGROUND OF THE INVENTION

The invention relates to the field of positioning and laying new track on railroad beds. In laying new track on a road bed, it is known to assist rail movement by using a device called a rail roller. The new rails are removed from a track car of a work train and slid along the ties of the road bed to their desired positions. These rails may be what are known as welded ribbon type rails which come in quarter mile lengths and are thus quite cumbersome to properly position over the rail ties between tie plates. Rail rollers facilitate rail placing. While the concept of roller assisted rail movement has been known for many years, and various rail rollers have been marketed, significant problems have been encountered with known roller devices. For example, rail rollers are known which use nylon bearings, which bearings prevent easy rotation of the roll surface. In addition, conventional rail rollers are adapted to set on top of rail ties so that side wise pressure will upset them. The present invention is directed to a novel rail roller device which provides significant advantages over known rail rollers.

SUMMARY OF THE INVENTION

It is an object of this invention to provide a rail roller device which will facilitate free and easy movement of rails to their designated positions along rail ties.

It is a further object of this invention to provide a rail roller device adapted to be positioned between successive rail ties so that the rollers resist side wise pressure and thus prevent tip over.

It is another object of the invention to provide a rail roller which is adapted to be located relative to rail ties so that rails on the rollers are located close to the tie plates.

It is still another object of the invention to provide a rail roller device adapted for free and easy rolling of the roll surface of the device while preventing the dislodging of the roller shaft bearing retaining ring.

To effect these objects, there is provided a novel rail roller device which includes a roller member having a generally cylindrically shaped roll surface to the ends of which are attached end plates or flanges extending radially beyond the roll surface. A roller shaft extends from the end plates for engagement with steel ball bearings. These bearings are sealed in a mounting bracket fixedly attached to a unique rail roller frame. The frame is generally rectilinear in shape having two longitudinal and two transverse frame members, each frame member being formed from a length of angle iron. The longitudinal frame members are positioned parallel to the longitudinal axis of the roller member and are arranged to be located between rail ties. These frame members also provide support surfaces for receiving mounting strips to which the mounting brackets carrying the steel ball bearings are attached. These support surfaces are further adapted to receive and provide support for the transverse frame members. The transverse frame members are located perpendicular to the longitudinal axis of the roller member and parallel to the track direction. These transverse members are selected to be of lengths sufficient to straddle two rail ties and are preferably separated from each other a distance greater than the width of a rail tie plate so that the rail roller device is stablely positioned in its desired location. A further feature of the invention involves the location of the bearing retaining ring. These retaining rings are located about the roller member shaft between a steel ball bearing and an end plate. By so locating a retaining ring, side wise or longitudinal movement of the roller member will not jar the retaining ring loose.

DETAILED DESCRIPTION OF THE PREFERRED EMBODIMENT

Figure 1:
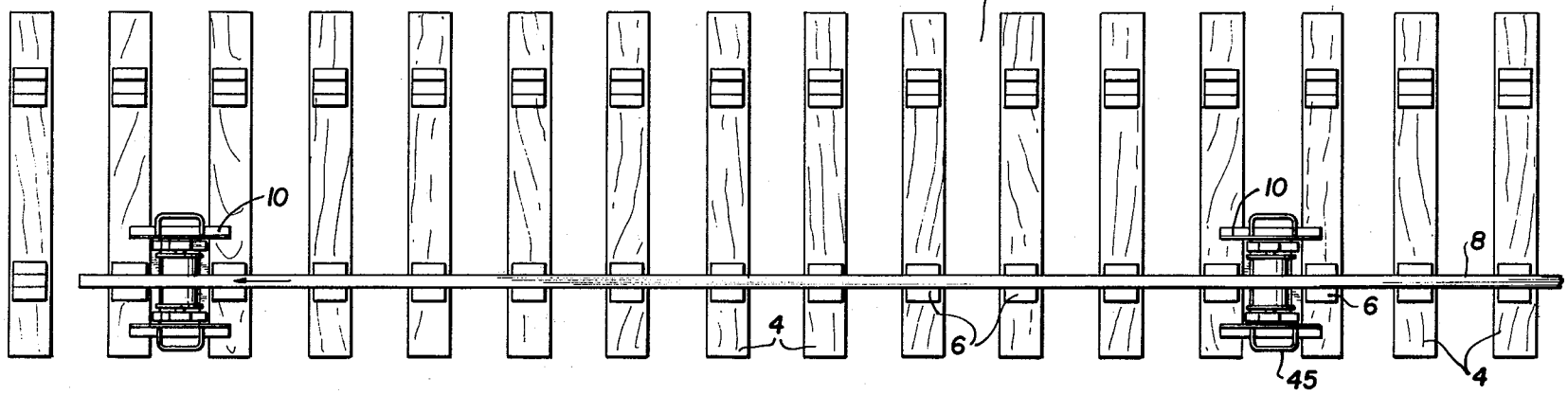
FIG. 1 illustrates a portion of a rail bed with the rail ties and tie plates located in the bed and showing the positioning of the rail rollers of the invention for use in rail positioning.

FIG. 1 illustrates a portion of a road bed 2 in which is located conventional rail ties 4 to which has been attached tie plates 6. New rail, such as quarter mile lengths of ribbon rail, is to be laid along the rail bed. A length of rail 8 will be positioned across the ties 4 and held in place by tie plate 6. In order to facilitate the positioning of the rail 8 along the bed, rail rollers 10 are used. Rail rollers designed in accordance with the teachings of the present invention are illustrated in FIGS. 2 and 3.

Figure 2:
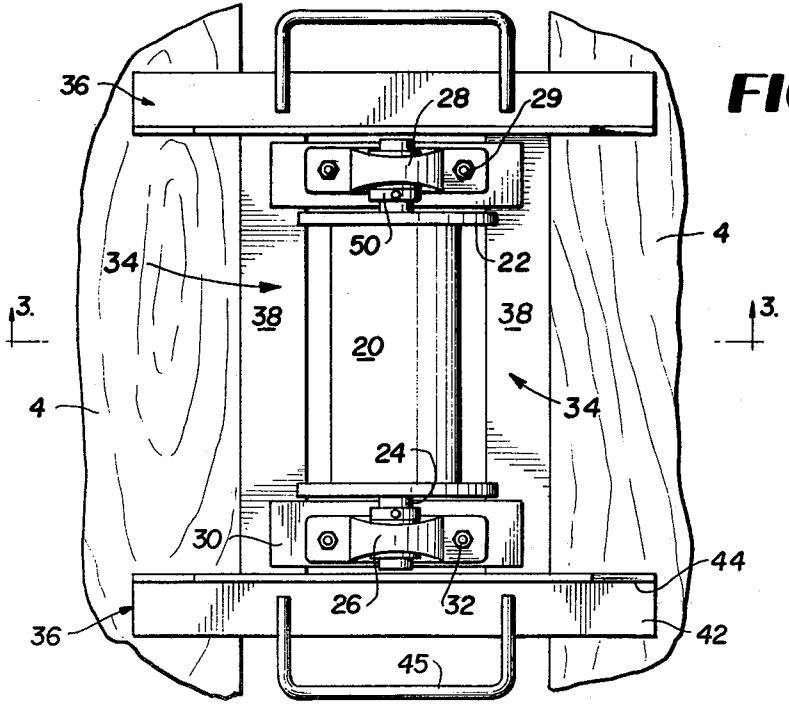
FIG. 2 is a top view of the rail roller device of the present invention.
Figure 3:
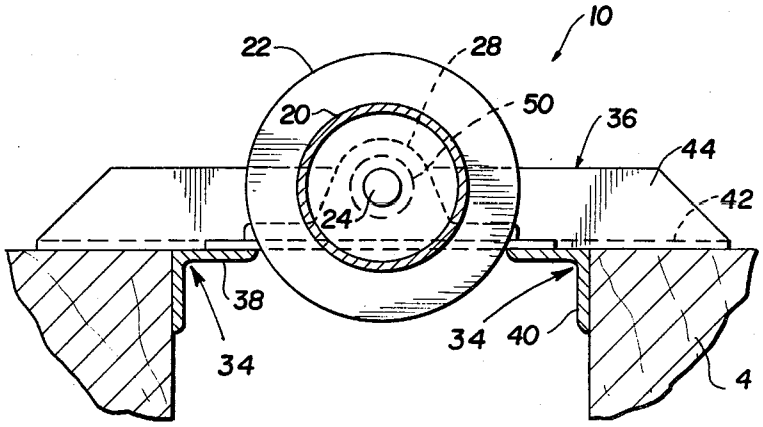
FIG. 3 is a side view of the rail roller device of the present invention.

Referring now to FIGS. 2 and 3, a rail roller device of the present invention is comprised of a roller member which is constructed of a cylindrical roll surface 20, to the ends of which are mounted end plates or flanges 22. These flanges extend radially from the longitudinal axis of the roll surface. A shaft 24 extends from the end plates 22 for engagement with steel ball bearings 26 retained in a generally U-shaped mounting bracket 28 having flange portions 29 through which suitable bolts or other retaining members pass for fixedly attaching the mounting brackets to the mounting strips 30.

The mounting strips 30 are attached to the frame of the roller device. The frame is comprised of a pair of longitudinally extending frame members 34 and a pair of transverse frame members 36. Each frame member is constructed from a length of angle iron. The longitudinal frame members 34 are adapted to provide support surfaces 38 and are separated from each other by a distance selected so that their projections 40 abut adjacent ties 4. The projections 40 extend orthagonally from the support surfaces 38 of the longitudinal frame members 34 and function to stabilize the frame and lock it between two rail ties 4 preventing undesirable movement of the rail roller device in the direction of rail travel while the rail is being positioned. These projections also prevent undesirable rotational movement of the entire frame in response to side wise pressure on the roller device.

One section 42 of each transverse frame member 36 is located in a plane parallel to the support surfaces 38 of the longitudinal frame members 34 and are adapted to rest upon and be supported by support surfaces 38. The sections 42 are fixedly attached to the support surfaces 38 by any suitable means such as welding. Sections 44 of the transverse frame members extend perpendicular to sections 42 in an upward direction away from the track bed. Handles 45 may be provided for lifting and moving the rail roller device 10. The transverse frame members 36 are selected to be of a length sufficient to straddle two adjacent ties 4. In addition, they are separated from each other by a distance greater than the width of the tie plates 6 so that they can sit solidly on the ties. The separation of the transverse frame member also aids in preventing undesirable rotational movement of the frame, which rotational movement tends to upset the roller device.

As illustrated in FIG. 2 a retaining ring 50 is located about the shaft 24 between an end plate 22 and a ball bearing 28. This retaining ring functions to limit the longitudinal movement of the roller member. Locating the retaining ring between the roller end plate 22 and the bearing 28 prevents dislodging of the ring 50 from the shaft 24 due to side wise forces occurring with longitudinal movement of rail roll surface as it rotates.

In operation, rail roller devices of the invention are placed at selected intervals along the road bed preferably in line with tie plates 6 as illustrated in FIG. 1. It has been found convenient to locate the rail rollers at about 40 foot intervals The rail is pulled off a rail car onto the rollers which aid in sliding the rail by their free rolling action. Due to the construction of the rail roller device of the present invention, rails 8 on rollers 10 are located quite close to the tie plates 6. Once the rail is properly positioned, it is raised up so that the rollers can be pulled out from under it and the rail is then set down in the tie plates on the ties.

What is claimed is:

1. A rail roller device for facilitating the positioning of rails in a rail bed containing a plurality of rail ties to which are affixed tie plates comprising:

a roller member connected to a frame, said frame consisting of a first pair of frame members extending parallel to the longitudinal axis of said roller member and a second pair of frame members extending transverse to said longitudinal axis, each member of said first pair of frame members having a support surface and an orthagonally projecting surface relative to said support surface, said members of said first pair of frame members being located to cause said orthagonally projecting surfaces to abut the sides of adjacent ties and inhibit the movement of said frame on said ties transverse to said longitudinal axis.

2. A rail roller device as claimed in claim 1 wherein said second pair of frame members are adapted to partially rest upon and be supported by the support surfaces of the said first pair of frame members.

3. A rail roller device as claimed in claim 2 wherein said roller member is comprised of a generally cylindrically shaped roll surface, flange plates affixed to the ends of said roll surface and a shaft extending from said flange plates.

4. A rail roller device as claimed in claim 3 further including steel ball bearings retained in mounting brackets and adapted to receive said shaft, mounting strips fixedly attached to the support surface of said first pair of frame members and attaching means for attaching said mounting brackets to said mounting strips.

5. A rail roller device as claimed in claim 4 further including a retaining ring located about said shaft and positioned between a flange plate of said roller member and a steel ball bearing.

6. A rail roller device as claimed in claim 1 wherein said transverse frame members are separated from each other by a distance greater than the width of said tie plates and said projecting surfaces inhibit rotational movement of the frame on said ties.

7. A rail roller device as claimed in claim 1 wherein said first pair of frame members each comprise an angle iron to form said support and orthogonally projecting surfaces.

8. A rail roller device as claimed in claim 7 wherein said support and orthogonally projecting surfaces are on the exterior of the angle of said angle iron and said second pair of frame members are mounted to the support surfaces of said first pair of frame members.

9. A rail roller device for facilitating positoning of rails in a rail bed comprising:

a roller member attached to a supporting frame; said roller member including a generally cylindrically shaped roll surface located concentric about a longitudinally extending shaft; said supporting frame includes a pair of longitudinal frame members extending parallel to the longitudinal axis of said roll surface, each having projections adapted to abut sides of adjacent rail ties to thereby inhibit rotational movement of the frame and a pair of transverse frame members, each having horizontal support surface; a ball bearing assembly on each end of said shaft mounted to said support surface; and a retaining ring secured to each end of said shaft between said roll surface and said ball bearing assembly.

* * * * *